US011145256B1

(12) United States Patent
Choi et al.

(10) Patent No.: US 11,145,256 B1
(45) Date of Patent: Oct. 12, 2021

(54) DYNAMIC CONTROL OF SCAN SIGNALS IN AMOLED DISPLAYS

(71) Applicant: Google LLC, Mountain View, CA (US)

(72) Inventors: Sangmoo Choi, Palo Alto, CA (US); Sang Young Youn, Cupertino, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/014,585

(22) Filed: Sep. 8, 2020

(51) Int. Cl.
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 2320/0626* (2013.01); *G09G 2330/021* (2013.01)

(58) Field of Classification Search
CPC ..... G09G 3/3266; G09G 2330/021
See application file for complete search history.

(56) References Cited

U.S. PATENT DOCUMENTS 9,711,080 B2 * 7/2017 Kang ..... G09G 3/3225
11,081,060 B2 * 8/2021 Park ..... G09G 3/3266
2010/0265280 A1 * 10/2010 Yen ..... G09G 3/3406 345/691
2012/0147060 A1 * 6/2012 Jeong ..... G09G 3/3233 345/690
2015/0109286 A1 * 4/2015 Verbeure ..... G09G 3/36 345/419
2020/0193910 A1 * 6/2020 Park ..... G09G 3/3258
2020/0394962 A1 * 12/2020 Seo ..... G09G 3/3266

OTHER PUBLICATIONS

Choi, et al., "Dynamic Control of Scan Signals in AMOLED Displays to Reduce Power Consumption", Technical Disclosure Commons; Retrieved from https://www.tdcommons.org/dpubs_series/3324/, Jun. 15, 2020, 9 pages.

* cited by examiner

*Primary Examiner* — Sepehr Azari
(74) *Attorney, Agent, or Firm* — Colby Nipper PLLC

(57) ABSTRACT

This document describes systems and techniques for dynamic control of scan signals in active-matrix organic light-emitting diode (AMOLED) displays. Displays in portable electronic devices, such as smartphones, include tens of thousands of pixels. Scan signals in the display control the brightness and color of individual pixels. A leading source of power consumption in AMOLED displays, however, is the parasitic capacitance in the scan lines that carry the scan signals. As the frame rate of AMOLED displays has increased, the frequency of scan signals and the associated parasitic capacitance has also increased. The described AMOLED display can dynamically control the number of pulses in scan signals to reduce power consumption without degrading image quality.

6 Claims, 6 Drawing Sheets

DYNAMIC CONTROL OF SCAN SIGNALS IN AMOLED DISPLAYS

BACKGROUND

Many portable electronic devices (e.g., smartphones, tablets, laptops, handheld video game consoles, and smartwatches) include displays. Such displays may use active-matrix organic light-emitting diode (AMOLED) technology to provide higher refresh rates, reduce display response times, and lower power consumption in comparison to other display technologies. These advantages make AMOLED displays well-suited for portable electronic devices, in large part because power consumption can have a large impact on user experience.

One of the leading factors for power consumption in an AMOLED display results from power dissipation in scan lines in the active areas or pixel array of the display. As the display charges and discharges the metal scan lines, parasitic capacitance in the scan lines leads to power loss. AMOLED displays, however, generally use multiple scan pulses per frame to improve brightness (e.g., by mitigating a hysteresis effect) and avoid motion blurring. Although multiple scan pulses can avoid motion blurring, the increased number of scan pulses per frame can also increase power consumption. Accordingly, it is challenging to provide an AMOLED display with power savings that can avoid hysteresis effects and motion blurring.

SUMMARY

This document describes systems and techniques for dynamic control of scan signals in AMOLED displays. Displays in portable electronic devices, such as smartphones, include tens of thousands of pixels. Scan signals in the display control the brightness and color of individual pixels. One of the leading sources of power consumption in AMOLED displays, however, is the parasitic capacitance in the scan lines that carry the scan signals. As the frame rate of AMOLED displays has increased (e.g., from 60 Hz to 90 Hz and 120 Hz), the frequency of scan signals has also increased, along with the associated power consumption from the parasitic capacitance. The described AMOLED display can dynamically control the number of pulses in scan signals to reduce power consumption without degrading image quality.

This Summary is provided to introduce simplified concepts of systems and techniques for dynamic control of scan signals in AMOLED displays, the concepts of which are further described below in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of one or more aspects of systems and techniques for dynamic control of scan signals in AMOLED displays are described in this document with reference to the following drawings. The same numbers are used throughout the drawings to reference like features and components.

DETAILED DESCRIPTION

This document describes systems and techniques for dynamic control of scan signals in AMOLED displays. AMOLED displays generally include multiple pulses per frame in the scan signal to improve pixel response time. In particular, the use of multiple scan pulses per frame can mitigate hysteresis effects and avoid motion blurring. As a result, the display generally reaches the target pixel luminance much faster. The described systems and techniques dynamically change the number of scan pulses per frame depending on image conditions to reduce power consumption and maintain optimal display performance.

Figure 1:
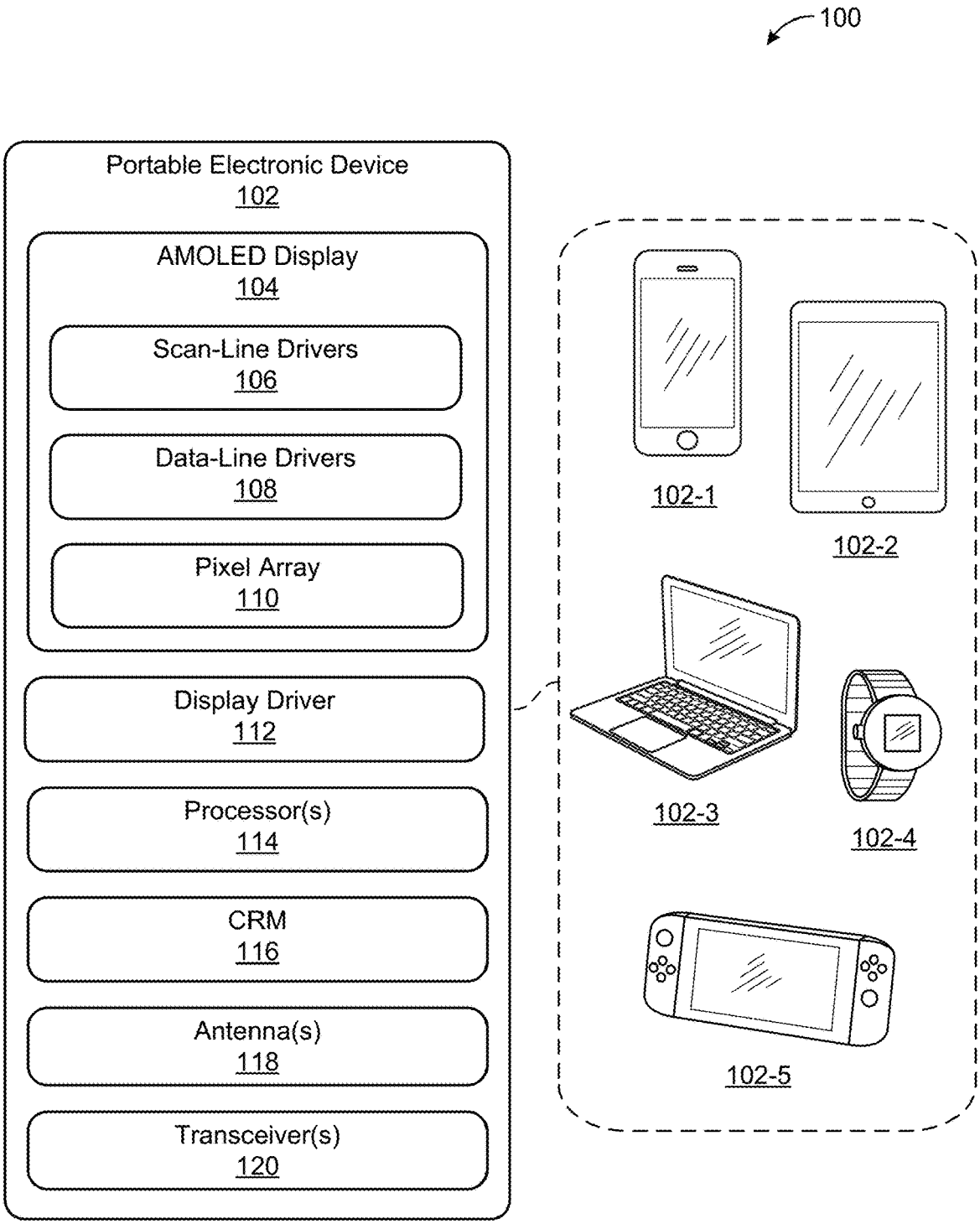
FIG. 1 illustrates an example device diagram of a portable electronic device in which dynamic control of scan signals in an AMOLED display can be implemented.

FIG. 1 illustrates an example device diagram 100 of a portable electronic device 102 in which dynamic control of scan signals in an AMOLED display 104 can be implemented. The portable electronic device 102 may include additional components and interfaces omitted from FIG. 1 for the sake of clarity.

The portable electronic device 102 can be a variety of consumer electronic devices. As nonlimiting examples, the portable electronic device 102 can be a mobile phone 102-1, a tablet device 102-2, a laptop computer 102-3, a computerized watch 102-4, a portable video game console 102-5, and the like.

The AMOLED display 104 includes a pixel array 110, which is controlled by a series of scan-line drivers 106 and data-line drivers 108. The pixel array 110 can generate light to create an image on the AMOLED display 104 upon electrical activation by the scan-line drivers 106. The data-line drivers 108 provide data to the pixel array 110 to control the luminance of individual pixels.

The computer system 102 includes one or more processors 114 operably connected to a display driver 112. The one or more processors 114 can include, as non-limiting examples, a system on chip (SoC), an application processor (AP), a central processing unit (CPU), or a graphics processing unit (GPU). An SoC, an AP, or a CPU generally executes commands and processes needed for the portable electronic device 102 and an operating system installed thereon. A GPU performs operations to display graphics of the portable electronic device 102 on the AMOLED display 104 and can perform other specific computational tasks. The one or more processors 114 can be single-core or multiple-core processors. The one or more processors can control the creation and display of an image on the AMOLED display 104.

The display driver 112 provides interfacing functionality between the one or more processors 114 and the AMOLED display 104. The display driver 112 can comprise hardware, firmware, software, or a combination thereof. The display driver 112 generally accepts commands and data from the one or more processors 114 and generates signals with appropriate voltage, current, timing, and demultiplexing to the scan-line drivers 106 and the data-line drivers 108 to enable the AMOLED display 104 to show the desired image.

The portable electronic device 102 also includes computer-readable storage media (CRM) 116. The CRM 116 is a suitable storage device (e.g., random-access memory (RAM), static RAM (SRAM), dynamic RAM (DRAM), non-volatile RAM (NVRAM), read-only memory (ROM), Flash memory) to store device data of the portable electronic device 102. The device data can include the operating system, one or more applications of the portable electronic device 102, user data, and multimedia data. The operating system generally manages hardware and software resources (e.g., the applications) of the portable electronic device 102 and provides common services for the applications. The operating system and the applications are generally executable by the processors 114 (e.g., an SoC, an AP, a CPU) to enable communications and user interaction with the portable electronic device 102.

In addition, the portable electronic device 102 can include one or more antenna(s) 118 and one or more radio frequency (RF) transceiver(s) 120 for communicating over wireless networks. The portable electronic device 102 can tune the antennas 118 and the RF transceivers 120 and supporting circuitry (e.g., front-end modules, amplifiers) to one or more frequency bands defined by various communication standards.

Figure 2:
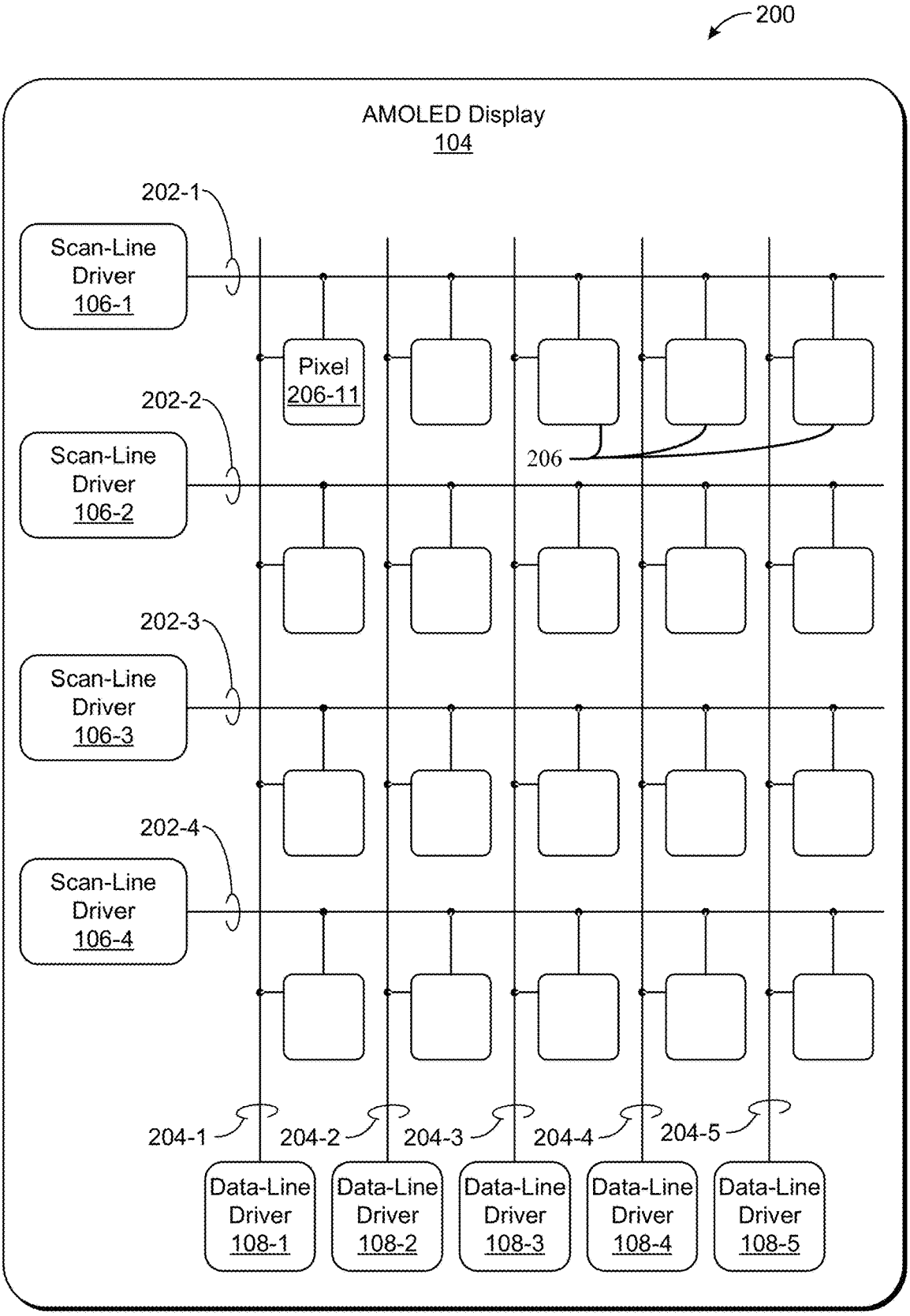
FIG. 2 illustrates an example device diagram of an AMOLED display in which dynamic control of scan signals can be implemented.

FIG. 2 illustrates an example device diagram 200 of the AMOLED display 104 in which dynamic control of scan signals 202 can be implemented. In this example, the AMOLED display 104 includes similar components to those illustrated in the AMOLED display 104 of FIG. 1, with some additional detail. The AMOLED display 104 can included additional components, which are not illustrated in FIG. 2.

The AMOLED display 104 consists of pixels 206 arranged in an array (e.g., the pixel array 110 from FIG. 1). The pixels 206 generate light upon electrical activation by a series of scan signals 202 (e.g., scan signals 202-1, 202-2, 202-3, and 202-4) generated by the scan-line drivers 106 (e.g., scan-line drivers 106-1, 106-2, 106-3, and 106-4) over the horizontal scan lines. The pixels 206 sit on an array of thin-film transistors (TFTs), which function as a series of switches to control the current flowing to each pixel 206. The data-line drivers 108 (e.g., data-line drivers 108-1, 108-2, 108-3, 108-4, and 108-5) provide data signals 204 (e.g., data signals 204-1, 204-2, 204-3, 204-4, and 204-5) over the vertical data lines to control the luminance of the individual pixels 206 (e.g., 206-11).

In operation, the data-line drivers 108 can provide the respective data signals 204 to the TFTs associated with the respective pixels 206. As an example, the data-line driver 108-1 can send the data signal 204-1 to the pixel 206-11 (and the other pixels 206 operatively coupled to the data-line driver 108-1). The scan-line drivers 106 can generate the respective scan signals 202 to activate the TFTs associated with the respective pixels 206. For example, the scan-line driver 106-1 can activate the TFT associated with the pixel 206-11 (and the other pixels 206 operatively coupled to the scan-line driver 106-1). In this manner, the AMOLED display 104 can generate an image.

Figure 3:
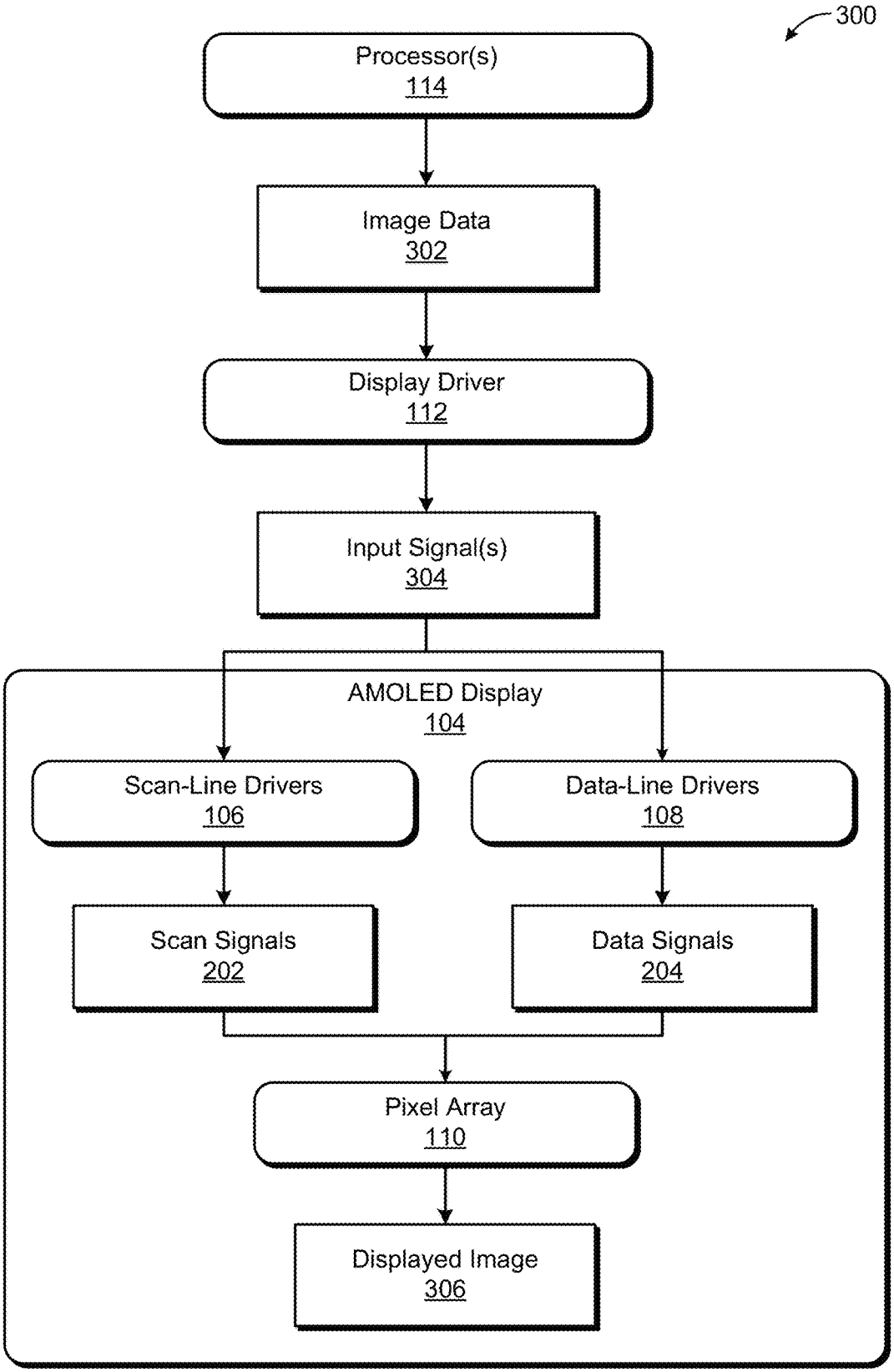
FIG. 3 is a flowchart illustrating an example method to dynamically control scan signals in an AMOLED display.

FIG. 3 is a flowchart 300 illustrating interactions of components of the AMOLED display 104 to dynamically control the scan signals 202. The flowchart 300 is shown as a set of components and outputs (e.g., signals, data) thereof, but are not necessarily limited to the order or combinations shown. The flowchart 300 is described in the context of the AMOLED display 104 of FIGS. 1 and 2, reference to which is made for example only. The flowchart 300 may include outputs in a different order or with additional or fewer components and outputs thereof. Further, any of one or more of the outputs of flowchart 300 may be repeated, combined, reorganized, or linked to provide a wide array of additional and/or alternate outputs.

As described with respect to FIG. 1, the portable electronic device 102 includes one or more processors 114. The one or more processors 114 can include a SoC, an AP, a CPU, or a GPU to control the creation and display of a displayed image 306 on the AMOLED display 104. As illustrated in FIG. 3, the one or more processors 114 transmit image data 302 to the display driver 112. The image data 302 includes information regarding the displayed image 306. The image data 306 can also include a flag signal to indicate to the display driver 112 whether the image data 306 for the next frame is the same as or changed from the image data 306 for the previous frame. Alternatively, the display driver 112 can detect whether the image data 306 is the same as the image data 306 for the previous frame.

The display driver 112 processes the image data 302 and provides one or more input signals 304 to the scan-line drivers 106 and the data-line drivers 108 to enable generation of the displayed image 306 for the next frame. Based on the flag signal from the one or more processors 114 or its self-detection, the display driver 112 can determine the number of scan pulses for the scan signals 202 of the next frame and include this information in the one or more input signals 304. The scan-line drivers 106 then output the scan signals 202 on each scan line with the determined number of scan pulses.

Figure 4A:
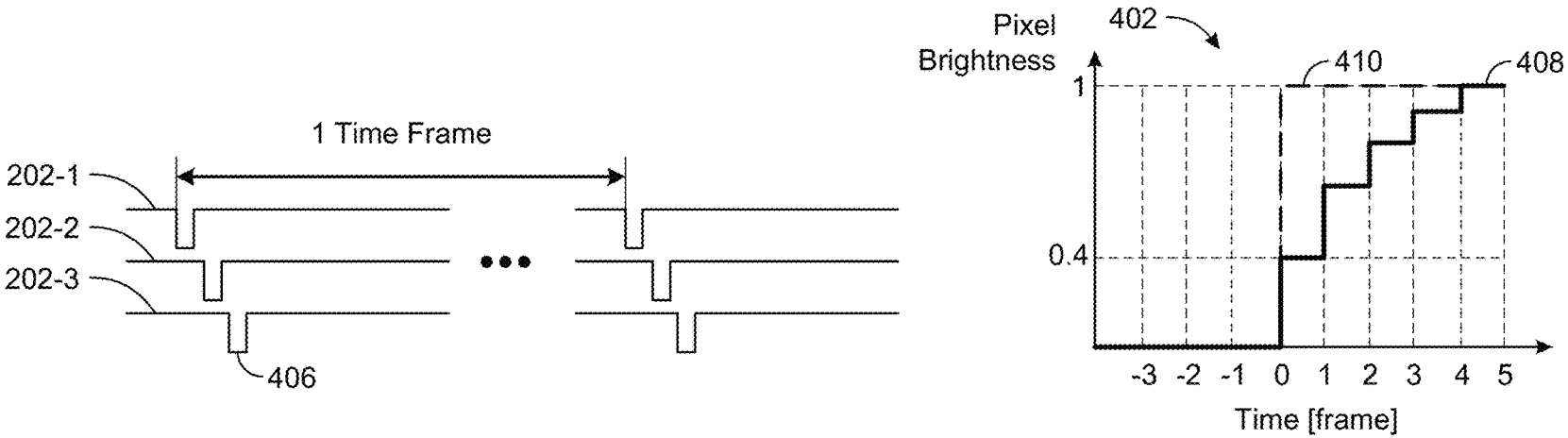
FIGS. 4A and 4B illustrate an example response of an AMOLED display to a single scan pulse and three scan pulses per frame, respectively.
Figure 4B:
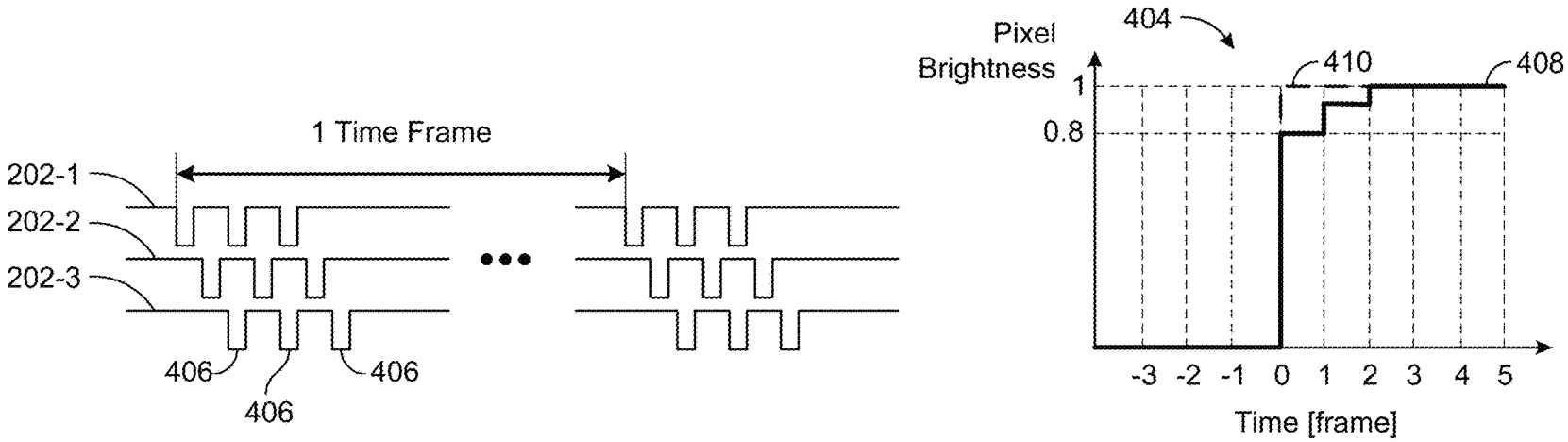

FIGS. 4A and 4B illustrate different example responses of the AMOLED display 104 to a single scan pulse 406 and three scan pulses 406 per frame, respectively. As described above, the AMOLED display 104 generally includes multiple pulses 406 per frame in the scan signal 202 (e.g., scan signals 202-1, 202-2, and 202-3) to improve pixel response time.

The AMOLED display 104 can change the luminance of the pixels 206 from black (e.g., gray 0 in 8-bit grayscale) to white (e.g., gray 255 in 8-bit grayscale). If the scan signal 202 includes a single pulse 406 per frame as illustrated in FIG. 4A, it can take several frames (e.g., four frames) for a pixel luminance 408 to reach a target luminance 410, which is illustrated by a plot 402. As an example, the scan signals 202-1, 202-2, and 202-3 include a single pulse 406 per frame. The plot 402 illustrates that the pixel luminance 408 of a pixel 206 reaches about 0.4, or approximately forty percent, of the target luminance 410 after the first time frame. Consequently, the pixel 206 reaches the target luminance 410 in approximately four time frames. The delay in reaching the target luminance 410 is due to a hysteresis effect of the TFTs, which can cause motion blurring of the displayed image 306.

The AMOLED display 104 can use multiple scan pulses per frame to mitigate the hysteresis effects and avoid motion blurring. As illustrated in FIG. 4B, the scan signal 202 (e.g., scan signals 202-1, 202-2, and 202-3) can include three pulses 406 per frame. The AMOLED display 104 generally reaches the target pixel luminance 410 much faster (e.g., two frames) with multiple scan pulses, which is illustrated in a plot 404. The plot 404 illustrates that the pixel luminance 408 of the pixel 206 reaches about 0.8, or approximately eighty percent, of the target luminance 410 after the first time frame. The increased number of scan pulses 406 can also cause the pixel luminance 408 after the first frame to be much closer to the target luminance 410.

Example Configurations

This section illustrates example configurations of an AMOLED display, which may operate separately or together in whole or in part. This section describes various example configurations, each set forth in relation to a figure for ease of reading. These figures do not limit the interoperability of each of these operations and/or configurations.

Figure 5:
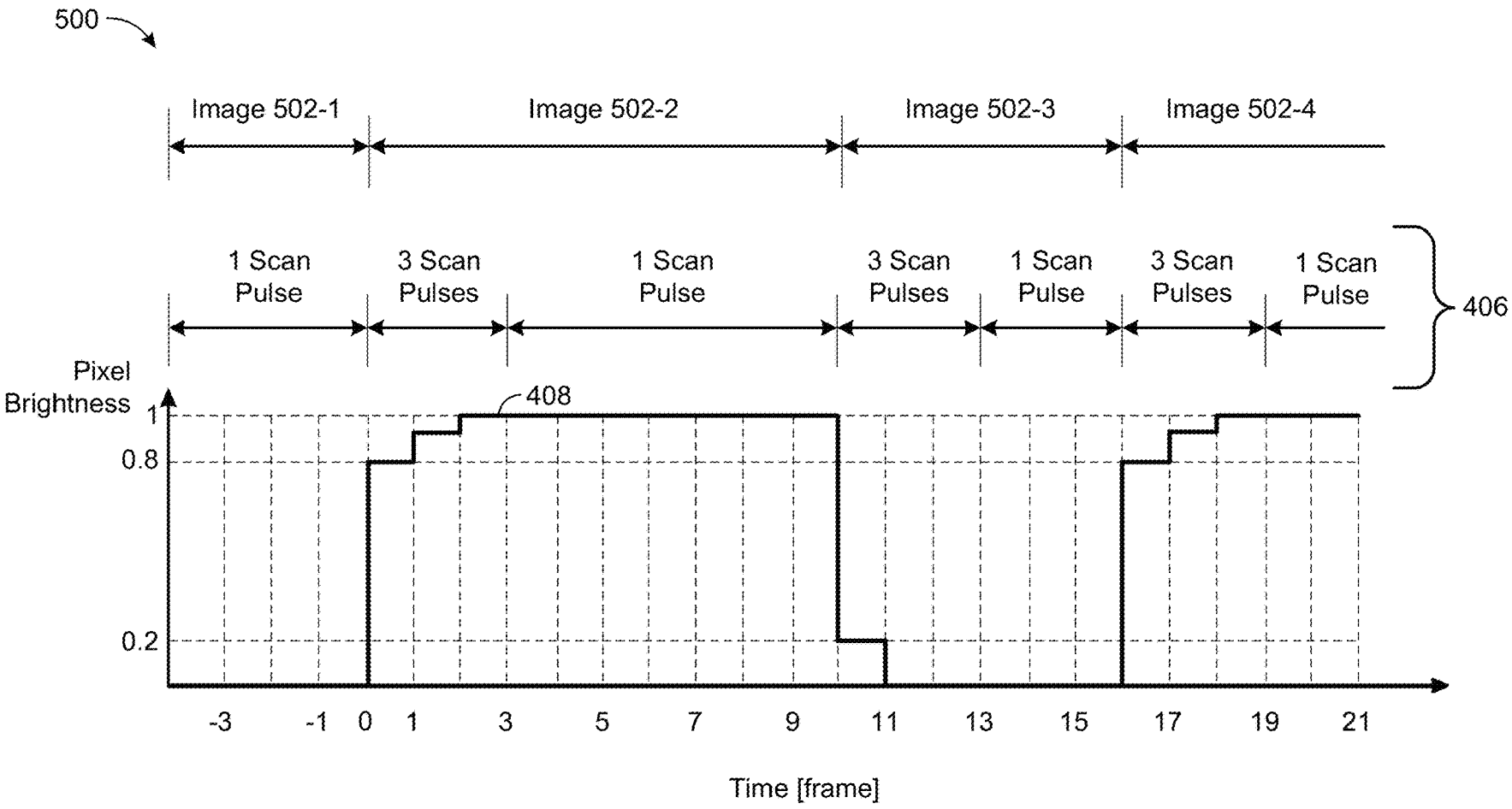
FIG. 5 illustrates an example response of an AMOLED display to a dynamic change in the number of scan pulses per frame.

FIG. 5 illustrates an example response 500 of the AMOLED display 104 to a dynamic change in the number of scan pulses 406 per frame. The response 500 is described in the context of the AMOLED display 104 of FIGS. 1-4. The response 500 may be performed in a different order or with additional or fewer operations than illustrated.

When an image 502 to be displayed on the portable electronic device 102 changes, the scan signals 202 include multiple pulses 406 (e.g., three pulses) per frame. If the image 502 remains unchanged for a certain number of time frames (e.g., three frames), the scan signals 202 include a single pulse 406 per frame.

As an example, the image 502 changes at Frame 0 from an image 502-1 to an image 502-2. In response to the image change at Frame 0, the scan signal 202 (not shown in FIG. 5) includes three pulses 406 per frame for Frames 1-3. Based on the use of three pulses 406 per frame in the scan signals 202, the pixel luminance 408 of the AMOLED display 104 can reach the target luminance after two frames. After the third frame, the scan signal 202 reverts to a single pulse 406 per frame to reduce power consumption as long as the image 502-2 remains unchanged. At Frame 10, a new image 502-3 is to be displayed. In response to the image change at Frame 10, the scan signal 202 includes three pulses 406 per frame for Frames 11-13. After Frame 13, the scan signal 202 reverts to a single pulse 406 per frame to reduce power consumption as long as the image 502-3 remains unchanged.

At Frame 16, a new image 502-4 is to be displayed. In response to the image change from the image 502-3 to the new image 502-4 at Frame 16, the scan signal 202 includes three pulses 406 per frame for Frames 17-19. After Frame 19, the scan signal 202 reverts to a single pulse 406 per frame to reduce power consumption as long as the image 502-4 remains unchanged.

A still-image display does not require multiple scan pulses 406 to avoid potential motion blurring. By reducing the number of scan pulses 406 for a static display, the AMOLED display 104 can reduce its power consumption.

Figure 6:
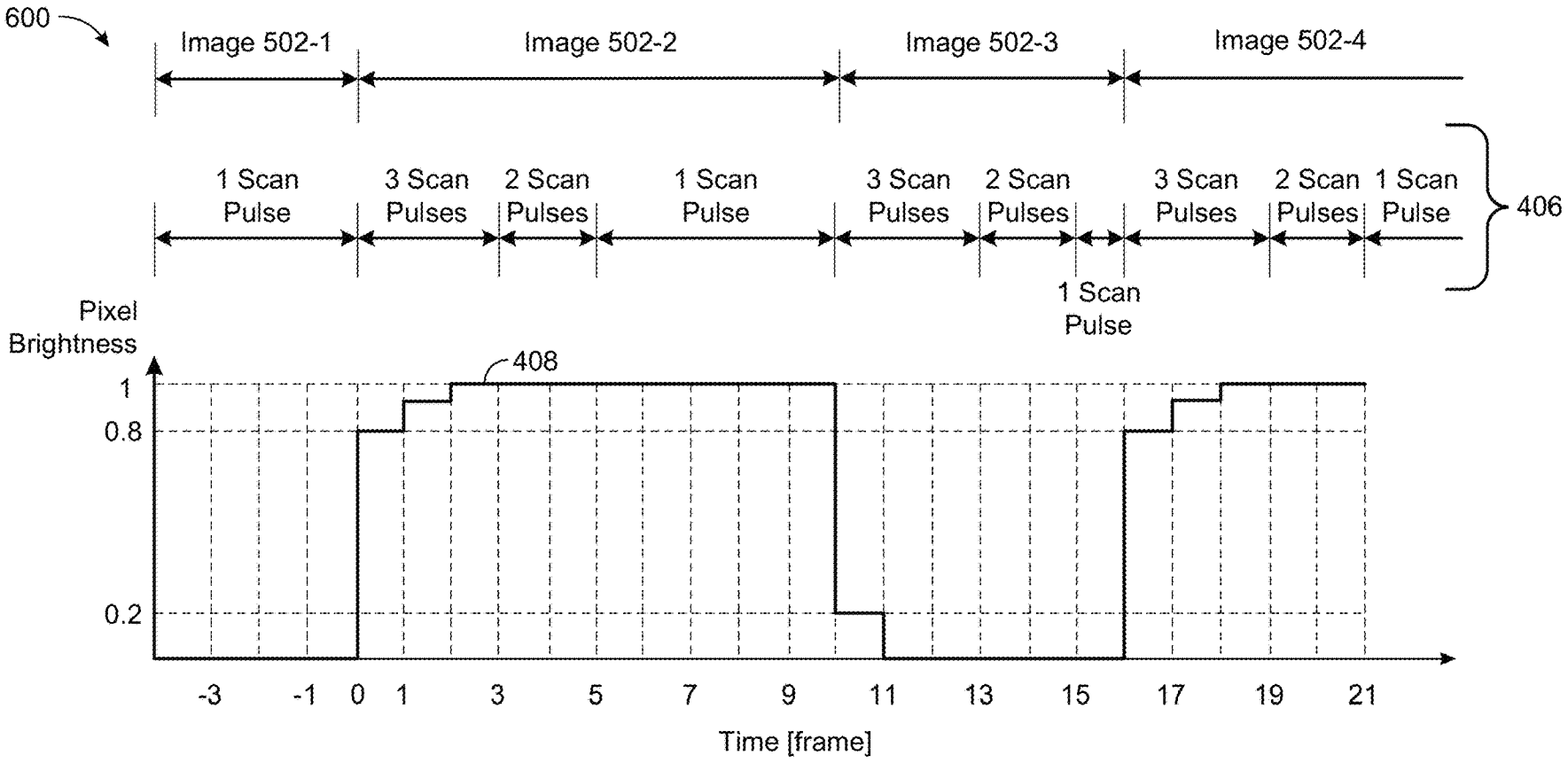
FIG. 6 illustrates another example response of an AMOLED display to a dynamic change in the number of scan pulses per frame.

FIG. 6 illustrates another example response 600 of an AMOLED display to a dynamic change in the number of scan pulses 406 per frame. The response 600 is described in the context of the AMOLED display 104 of FIGS. 1-4. The response 600 may be performed in a different order or with additional or fewer operations than illustrated. The response 600 is similar to the response 500 illustrated in FIG. 5, but it includes two scan pulses 406 per frame as a transition from three pulses per frame to one pulse per frame.

In some instances, the pixel luminance 408 can change when the number of scan pulses is adjusted (e.g., from three pulses per frame to one pulse per frame). If the number of scan pulses changes from three pulses per frame to one pulse per frame, the pixel luminance 408 can be noticeably lower. In such situations, the display driver 112 can cause a transitional number of pulses per frame to adjust the pixel luminance gradually. The number of frames with the transitional number of pulses can be determined, for example, empirically from user-impact studies.

As an example, when the image 502 to be displayed on the portable electronic device 102 changes, the scan signals 202 include multiple pulses 406 (e.g., three pulses) per frame. If the image 502 remains unchanged for a certain number of time frames (e.g., three frames), the scan signals 202 include a smaller, transitional number of multiple pulses 406 (e.g., two pulses) per frame for a certain number of time frames (e.g., two frames). If the image 502 still remains unchanged, the scan signals 202 include a single pulse 406 per frame until the time image 502 changes. In this way, the pixel luminance 408 does not noticeably change as the number of scan pulses 406 is lowered to reduce power consumption.

As an example, the image 502 changes at Frame 0 from an image 502-1 to an image 502-2. In response to the image change at Frame 0, the scan signal 202 (not illustrated in FIG. 6) includes three pulses 406 per frame for Frames 1-3. Based on the use of three pulses 406 per frame in the scan signals 202, the pixel luminance 408 of the AMOLED display 104 can reach the target luminance after two frames. After the third frame, the scan signal 202 uses two pulses 406 per frame for Frames 4 and 5 to avoid a noticeable lowering the of the pixel luminance 408 by a user. For Frames 6-10, the scan signal 202 uses a single pulse 406 per frame to reduce power consumption as long as the image 502-2 remains unchanged.

At Frame 10, a new image 502-3 is to be displayed. In response to the image change at Frame 10, the scan signal 202 includes three pulses 406 per frame for Frames 11-13. After Frame 13, the scan signal 202 uses two pulses 406 for Frames 14 and 15 and a single pulse 406 as long as the image 502-3 remains unchanged.

At Frame 16, a new image 502-4 is to be displayed. In response to the image change at Frame 16, the scan signal 202 includes three pulses 406 per frame for Frames 17-19. After Frame 19, the scan signal 202 uses two pulses 406 for Frames 20 and 21 and a single pulse 406 as long as the image 502-4 remains unchanged.

A recent trend in portable electronic devices 102 is for the AMOLED display 104 to provide a high frame rate (e.g., 90 Hz, 120 Hz). For example, some portable electronic devices 102 use a dynamic refresh rate that varies the frame rate based on the type of content to be displayed (e.g., higher frames rates for videos and games that generally have moving images). As the frame rate increases, motion blurring may not be perceptible to users because of the improved and faster image-refresh speed.

In other implementations, if the portable electronic device 102 doubles the display's frame rate (e.g., from 60 Hz to 120 Hz), the pixel response time can be approximately the same even with fewer scan pulses 406. Although the 120-Hz display can use, for example, four frames to reach a target luminance, it can reach the target luminance 410 in the same amount of time as the 60-Hz display. In situations when the portable electronic device 102 operates at higher frame rates (e.g., 90 Hz or 120 Hz), the display driver 112 can reduce the number of scan pulses 406 to reduce power consumption without noticeably affecting the performance of the AMOLED display 104. Similarly, the portable electronic device 102 can use a single scan pulse 406 when it switches to a power-saving mode. In such situations, the portable electronic device 102 can alert the user that there may be some motion blurring for moving images.

Alternatively, the portable electronic device 102 can vary the number of scan pulses 406 when the AMOLED display 104 is using a dynamic refresh rate. When the AMOLED display 104 is using a low frame rate for still or slow-moving image content, a single scan pulse 406 drives the pixel array 110. The scan signal 202 can include multiple scan pulses 406 when the portable electronic device 102 is using a high frame rate for fast-moving image content (e.g., video games). In combination with the dynamic refresh rate, the changing number of scan pulses 406 can improve the optical performance of the AMOLED display 104 (e.g., reduced motion blur), while also reducing power consumption for still images.

Although concepts of systems and techniques for dynamic control of scan signals in AMOLED displays have been described in language specific to the illustrated systems and/or techniques, it is to be understood that the subject of the appended claims is not necessarily limited to the described systems and/or techniques. Rather, the specific systems and techniques are disclosed as example implementations of ways in which dynamic control of scan signals in AMOLED displays can be implemented.

What is claimed is:

1. An active-matrix organic light-emitting diode (AMOLED) display, the AMOLED display comprising:

a display driver, the display driver configured to determine whether an image to be displayed in a current frame has changed from an image displayed in a previous frame; and multiple scan-line drivers, each of the multiple scan-line drivers operatively coupled to a respective subset of multiple pixels of the AMOLED display, the multiple scan-line drivers configured to:

in response to a determination that the image to be displayed in the current frame has changed from the image displayed in the previous frame, activate the respective subset of multiple pixels with a scan signal including multiple scan pulses for the current frame; and in response to a determination that the image to be displayed in the current frame has not changed from the image displayed in the previous frame, determine whether the image to be displayed in the current frame has changed within a multiple number of frames preceding the previous frames.

2. The AMOLED display of claim 1, wherein each of the multiple scan-line drivers is further configured to:

in response to a determination that the image to be displayed in the current frame has changed within the multiple number of frames preceding the previous frame, activate the respective subset of multiple pixels with the scan signal including the multiple scan pulses for the current frame; and in response to a determination that the image to be displayed in the current frame has not changed within the multiple number of frames preceding the previous frame, activate the respective subset of multiple pixels with a scan signal including a single scan pulse for the current frame.

3. The AMOLED display of claim 2, wherein:

the multiple scan pulses comprise three scan pulses; and the multiple number of frames preceding the previous frame is three.

4. The AMOLED display of claim 1, wherein:

the multiple scan pulses comprise a first number of scan pulses, the first number of scan pulses being at least three scan pulses;

in response to the determination that the image to be displayed in the current frame has not changed from the image displayed in the previous frame, the display driver is further configured to determine whether the image to be displayed in the current frame has changed within another multiple number of frames preceding the previous frame, the other multiple number of frames preceding the previous frame being greater than the multiple number of frames preceding the previous frame; and each of the multiple scan-line drivers is further configured to:

in response to a determination that the image to be displayed in the current frame has changed within the multiple number of frames preceding the previous frame but not within the other multiple number of frames preceding the previous frame, activate the respective subset of multiple pixels with the scan signal including the first number of scan pulses for the current frame;

in response to a determination that the image to be displayed in the current frame has changed within the other multiple number of frames preceding the previous frame, activate the respective subset of multiple pixels with the scan signal including a second number of scan pulses for the current frame, the second number of scan pulses being at least two scan pulses and lower than the first number of scan pulses; and in response to a determination that the image to be displayed in the current frame has not changed within the other multiple number of frames preceding the previous frame, activate the subset of multiple pixels with a scan signal including a single scan pulse for the current frame.

5. The AMOLED display of claim 4, wherein:

the first number of scan pulses comprises three scan pulses and the second number of scan pulses comprises two scan pulses; and the multiple number of frames preceding the previous frame is three and the other multiple number of frames preceding the previous frame is five.

6. The AMOLED display of claim 1, wherein:

the display driver is further configured to receive, from a processor operably connected to the display driver, a flag signal that indicates that the image to be displayed in the current frame has changed from the previous frame.

* * * * *